United States Patent [19]

Hornsby

[11] 4,098,486

[45] Jul. 4, 1978

[54] BATHROOM CADDY

[76] Inventor: Isaac W. Hornsby, 2706 Anza St., Bakersfield, Calif. 93305

[21] Appl. No.: 783,181

[22] Filed: Mar. 31, 1977

[51] Int. Cl.[2] ..... A47B 97/04

[52] U.S. Cl. ..... 248/452; 108/159; 248/455

[58] Field of Search ..... 248/452, 441 B, 441 C, 248/441 D, 447, 448, 460, 454, 455, 456; 211/86, 133; 297/148, 149, 153; 108/49, 137, 159

[56] References Cited

U.S. PATENT DOCUMENTS

| | | | |
|---|---|---|---|
| 1,082,884 | 12/1913 | Leonard | 297/153 |
| 2,521,899 | 9/1950 | Carlin | 242/55.2 |
| 2,542,512 | 2/1951 | Gunderson | 211/133 |
| 2,759,454 | 8/1956 | Swart | 120/33 |
| 2,765,999 | 10/1956 | Baker | 248/124 |
| 2,896,793 | 7/1959 | Bogart | 211/132 |
| 3,168,061 | 2/1965 | Bedol | 108/49 |
| 3,416,764 | 12/1968 | Bier | 248/452 |
| 3,475,052 | 10/1969 | Kaposi | 297/153 |
| 3,692,273 | 9/1972 | Woolman | 248/452 |

*Primary Examiner*—Robert A. Haffer
*Attorney, Agent, or Firm*—Max E. Shirk

[57] ABSTRACT

A book support is swingably connected to a tray having end pieces which may be adjusted to support tray on a bathtub or on a bed. A stand or base member is also provided for supporting the tray in front of a seated person.

5 Claims, 4 Drawing Figures

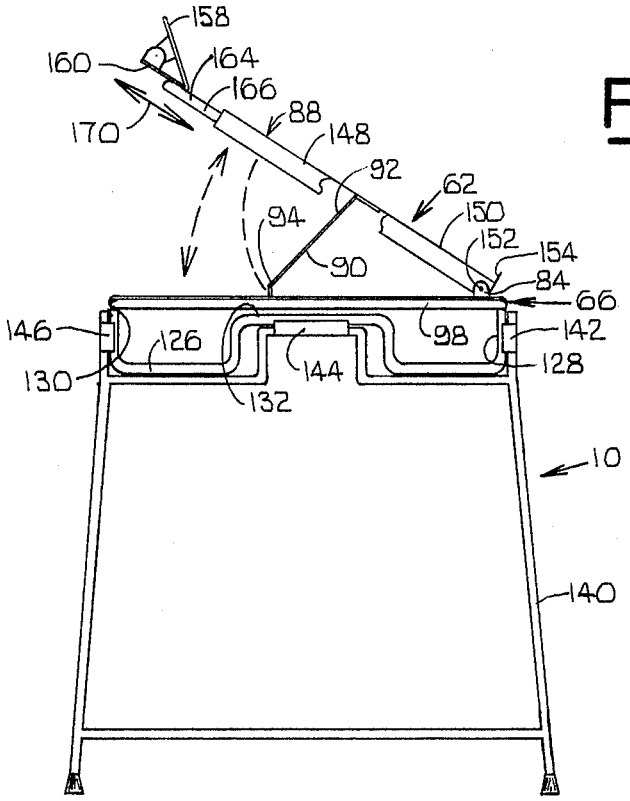
Fig. 3
Fig. 4
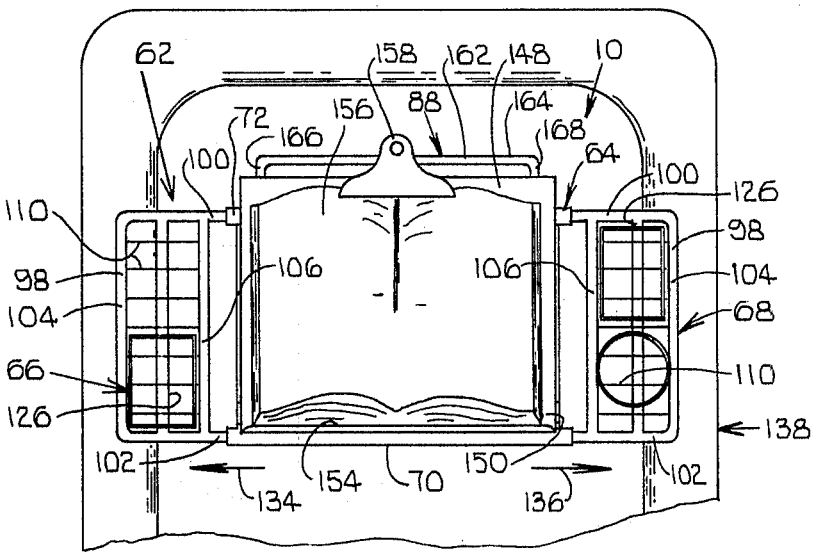

BATHROOM CADDY

BACKGROUND OF THE INVENTION

The background of the invention will be set forth in two parts.

1. Field of the Invention

The present invention pertains generally to the field of book supports and more particularly to a new and useful book support swingably connected to a tray having end pieces which may be adjusted to support the tray on a bathtub or on a bed. A stand or base member is also provided for supporting the tray in front of a seated person.

2. Description of the Prior Art

The prior art known to applicant is listed by way of illustration, but not of limitation, in separate communications to the United States Patent Office.

The present invention exemplifies improvements over this prior art.

SUMMARY OF THE INVENTION

According to the present invention, a new and useful bathroom caddy is provided. The caddy includes a base member having legs and a supporting surface at the upper ends of the legs. A tray is removably coupled to this supporting surface and a book support is swingably connected to the tray in such a manner that the book support may be maintained at various acute angles with respect to the tray.

The tray includes a frame portion to which the book support is connected. End pieces are adjustably connected to the ends of the frame portion for adjusting the width of the tray. Stop members depend from the end pieces for engagement with the inner walls of a bathtub so that the tray may be used to support a book in reading position on the bathtub.

When the tray is removed from the base member, short legs may be coupled to the depending stop members so that the tray may be used to support a book in reading position for a person in a bed.

If desired, a soap dish may be provided on one of the end pieces and an ashtray retainer, or the like, may be provided on the other of the end pieces.

Additionally, a shelf may be mounted on the base member adjacent the lower ends of its legs so that reading material may be stored on the bathroom caddy.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference characters to refer to like elements in the several views.

BRIEF DESCRIPTION OF THE DRAWINGS

FIG. 3 is an end view of the tray of FIG. 2 showing a pair of removable legs connected thereto; and FIG. 4 is a plan view of the tray of FIG. 2 in position in a bathtub.

DESCRIPTION OF THE PREFERRED EMBODIMENT

Figure 1:
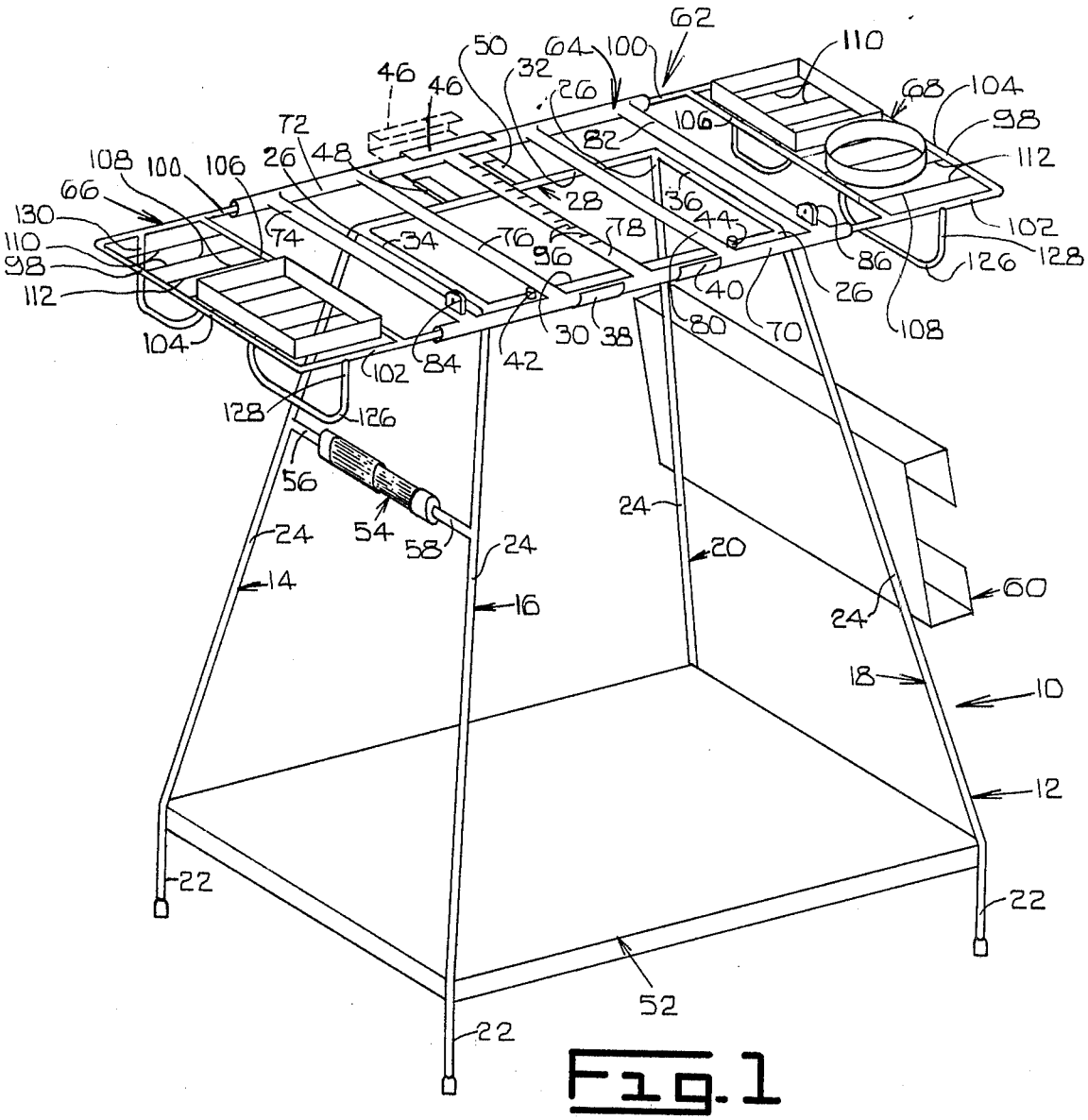
FIG. 1 is a perspective view of a stand or base member and removable tray of the present invention.

Referring again to the drawings, and more particularly to FIG. 1, a bathroom caddy constituting a presently-preferred embodiment of the invention, generally designated 10, includes a stand or base member 12 having four upstanding legs, 14, 16, 18 and 20. Each leg includes a substantially vertical lower end 22, an upwardly-inwardly sloping portion 24 and an upper end 26. Stand 12 includes an article-supporting surface which may be defined by a rectangular frame 28 affixed to the upper ends 26 of legs 14, 16, 18 and 20. Frame 28 includes a front rail 30, a rear rail 32, a left rail 34 and a right rail 36. A pair of L-shaped brackets 38, 40 and a pair of locator pins 42, 44 may be affixed to front rail 30 in the positions shown. Additionally, a spring-loaded clip 46 may be connected to rear rail 32 by a pair of sleeves 48, 50.

Stand 12 also includes a book-supporting shelf 52 which may be affixed to legs 14, 16, 18 and 20 adjacent their lower ends 22; a toilet-paper roller 54, which may be affixed to legs 14, 16 by rods 56, 58, respectively; and a receptacle 60, which may be affixed to legs 18, 20 for receiving a box of facial tissues.

Referring now to FIGS. 1–4, bathroom caddy 10 also includes a tray 62 having a frame portion 64 and a pair of adjustable end pieces 66, 68.

Frame 64 is shown herein for purposes of illustration, but not of limitation, as being fabricated primarily from bar stock and includes front and rear hollow tubular members 70, 72, respectively, maintained in spaced-apart relationship by a plurality of rods 74, 76, 78, 80 and 82. Apertured brackets 84, 86 may be affixed to rods 74, 82, respectively, adjacent front tubular member 70 for swingably receiving a book support 88 which may be maintained and different acute angles with respect to tray 62 by a leg 90 (FIGS. 2 and 3) having a first end 92 swingably connected to book support 88 and a second end 94 selectively engageable in a plurality of notches 96 (FIG. 1) provided on rod 78.

Tray 62 may be readily coupled to support or frame 28 by engaging rod 70 in brackets 38, 40 while moving clip 46 to its broken-line position and lowering rod 72 into a horizontal position where it will be engaged by clip 46 when it is released. Tray 62 may be properly centered on support 28 by positioning rods 76, 80 inside of pins 42, 44, respectively.

The end pieces 66, 68 each includes a U-shaped member having a pair of legs 100, 102, which are telescopically received in tubular members 72, 70, respectively, and a bight portion or outboard end 104. End pieces 66, 68, also each include a transverse rod 106 affixed to legs 100, 102 adjacent bight portion 104 for supporting the ends 108 of a plurality of stiff wires 110 having their other ends 112 affixed to bight portion 104. Rods 110 on end piece 66 may form the bottom of a receptacle 114 formed by an encompassing sidewall 116 and the rods 110 on end piece 68 may form the bottom of a pair of receptacles 118, 120 formed by encompassing sidewalls 122, 124, respectively.

The end pieces 66, 68 each also includes a depending stop member 126 having front and rear vertical portions 128, 130, respectively, and a central horizontal portion 132 (FIG. 3). End piece 66 may be moved in the direction of arrow 134 and end piece 68 may be moved in the direction of arrow 136 (FIGS. 2 and 4) to bring stop members 126, which are inboard of outboard ends 104, into engagement with the inner walls of a bathtub 138 (FIG. 4) when it is desired to support tray 62 on bathtub 138. Alternatively, stop members 126 may be releasably engaged by a pair of legs 140 (FIG. 3) when it is desired to use tray 62 as a bed tray. Legs 140 may be provided with a front U-shaped clip 142, a middle U-shaped clip 144 and a rear U-shaped clip 146 for frictionally engaging vertical portion 128, horizontal portion 132 and vertical portion 130 of stop member 126, respectively, when it is desired to releasably couple legs 140 to tray 62.

Figure 2:
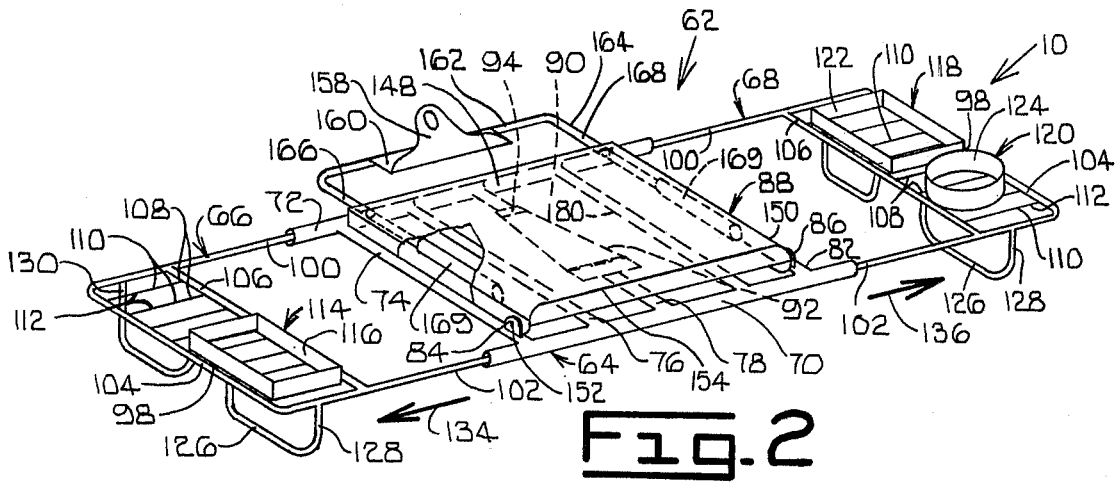
FIG. 2 is a perspective view of the tray of FIG. 1 showing a book support swingably connected thereto.

Referring now to FIGS. 2–4, book support 88 includes a base member 148 having a lower end 150 connected to brackets 84, 86 by suitable pivot pins, like the one shown at 152 for bracket 84. An upstanding lip 154 is affixed to end 150 for supporting a book 156 (FIG. 4). The upper end of book 156 may be secured by a spring-loaded clip 158 affixed to a plate 160 which, in turn, is affixed to the bight portion 162 of an adjustable book support 164 having legs 166, 168 slideably mounted in sleeves 169 (FIG. 2) for adjustable movement, as indicated by arrow 170 in FIG. 3, to accommodate reading material of different lengths.

The manner in which bathroom caddy 10 may be used is belived to be apparent and will be briefly summarized at this point.

Tray 62 may be attached to stand 12 and book support 88 may be adjusted to support reading material at a suitable height for a person seated in front of caddy 10.

Trays 62 and book support 88 may be readily removed from stand 12 and placed on bathtub 138 by moving end pieces 66, 68 to the positions shown in FIG. 4 for supporting reading material at a position suitable for a person sitting in bathtub 138.

Additionally, legs 140 may be readily connected to end pieces 66, 68 for supporting reading material in a position suitable for a person reclining in a bed.

While the particular bathroom caddy herein shown and described in detail is fully capable of attaining the objects and providing the advantages hereinbefore stated, it is to be understood that it is merely illustrative of the presently-perferred embodiment of the invention and that no limitations are intended to the details of construction or design herein shown other than as defined in the appended claims, which form a part of this disclosure.

Whenever the term "means" is employed in these claims, this term is to be interpreted as defining the corresponding structure illustrated and described in this specification or the equivalent of the same.

What is claimed is:

1. A bathroom caddy comprising:

a base member having legs and a supporting surface at the upper ends of said legs;

a tray;

means for readily and easily coupling said tray to said supporting surface;

a book support;

means swingably connecting said book support to said tray;

means connected to said book support for maintaining it at various acute angles with respect to said tray, said tray including a frame portion to which said book support is pivotably connected, said frame portion having a first end and a second end, first and second end pieces adjustably connected to said first and second ends, respectively, for adjusting the width of said tray, and means depending from each of said end pieces for engagement with the inner walls of a bathtub, whereby said tray may be used to support a book in reading position on said bathtub;

first and second pairs of short legs; and means provided at the upper ends of each pair of short legs for coupling them to an associated one of said means depending from each of said end pieces, whereby said tray may be used to support a book in reading position for a person in a bed.

2. A bathroom caddy as stated in claim 1 including a shelf mounted on said base member adjacent the lower ends of said legs.

3. A bathroom caddy as stated in claim 1 wherein said book support comprises:

a base member having a lower end and an upper end;

an upstanding lip affixed to said lower end for supporting a book on said base member; and a spring-loaded clip slideably mounted on said base member at said upper end for securing reading material to said book support.

4. A bathroom caddy comprising:

a stand having legs and a supporting surface affixed to the upper ends of said legs;

a tray including a frame portion having first and second ends, a book support pivotably connected to said frame portion, first and second end pieces telescopically engaging said first and second ends of said frame portion, respectively, for adjusting the width of said tray, each of said end pieces having an outboard end, and a stop member depending from each of said end pices inboard of its outboard end for engagement with the inner walls of a bathtub, whereby said tray may be used to support a book in reading position on said bathtub, each of said stop members having front and rear vertical portions and a central horizontal portion;

a plurality of coupling members affixed to said supporting surface for readily and easily coupling said tray thereto; and a pair of short legs coupled to each of said stop members, each pair of said short legs including front, middle and rear U-shaped clips engaging an associated one of said front vertical portions, said central horizontal portions and said rear vertical portions, respectively.

5. A bathroom caddy comprising:

A. a stand including:

1. four upstanding legs each having a substantially vertical lower end, an upwardly-inwardly sloping portion and an upper end;
2. an article-supporting surface defined by a first rectangular frame affixed to the upper ends of said legs, said first frame having a front rail, a rear rail, a left rail and a right rail;
3. a pair of L-shaped brackets affixed to said front rail in spaced-apart relation;
4. a first pair of sleeves affixed to said rear rail in spaced-apart relation; and
5. a first spring-loaded clip slidably mounted in said sleeves;

B. a tray coupled to said first rectangular frame by said L-shaped brackets and said first spring-loaded clip, said tray including:

1. a second frame having front and rear hollow, tubular members and a plurality of rods affixed to said hollow tubular members for maintaining them in spaced-apart relation;

2. a first apertured bracket affixed to a first of said rods;
3. a second aperturned bracket affixed to a second of said rods;
4. a plurality of notches provided on a third of said rods;
5. a book support swingably connected to said apertured brackets, said book support including a base member, a second pair of sleeves affixed to said base member, a U-shaped member having a bight portion and a pair of legs slidably mounted in said second pair of sleeves and a second spring-loaded clip affixed to said bight portion;
6. a book-support leg having a first end swingably connected to said book support and a second end selectively engageable in said notches on said third rod; and
7. a pair of U-shaped end pieces each having a pair of legs telescopically received in said front and rear tubular members, a stop member depending from each of said end pieces, each of said stop members having front and rear vertical portions and a central horizontal portion; and C. a pair of short legs coupled to each of said stop members, each pair of said short legs including a front U-shaped clip engageable with an associated one of said front vertical portions, a middle U-shaped clip engageable with an associated one of said central horizontal portions and a rear U-shaped clip engageable with an associated one of said rear vertical portions.

* * * * *